US006052095A

United States Patent [19]

Ramanujam et al.

[11] Patent Number: 6,052,095

[45] Date of Patent: Apr. 18, 2000

[54] DUAL GRIDDED REFLECTOR ANTENNA

[75] Inventors: Parthasarathy Ramanujam, Redondo Beach; Philip H. Law, Encino; Nancy Garcia, El Segundo; Daniel A. White, Torrance, all of Canada

[73] Assignee: Hughes Electronics Corporation, El Segundo, Calif.

[21] Appl. No.: 09/267,097

[22] Filed: Mar. 10, 1999

[51] Int. Cl.[7] ..... H01Q 19/14

[52] U.S. Cl. ..... 343/781 P; 343/756; 343/781 R; 343/DIG. 2

[58] Field of Search ..... 343/781 R, 781 P, 343/756, DIG. 2, 757, 781 CA; H01Q 19/14

[56] References Cited

U.S. PATENT DOCUMENTS

| | | | |
|---|---|---|---|
| 4,625,214 | 11/1986 | Parekh | 343/756 |
| 4,647,938 | 3/1987 | Roederer | 343/756 |
| 4,823,143 | 4/1989 | Bockrath | 343/781 P |
| 4,978,967 | 12/1990 | Masujima | 343/781 R |
| 5,402,137 | 3/1995 | Ramanujam et al. | 343/781 P |
| 5,581,265 | 12/1996 | Stirland et al. | 343/756 |
| 5,673,056 | 9/1997 | Ramanujam et al. | 343/781 P |
| 5,847,681 | 12/1998 | Faherty et al. | 343/781 P |

*Primary Examiner*—Don Wong
*Assistant Examiner*—Hoang Nguyen
*Attorney, Agent, or Firm*—Terje Gudmestad; M. W. Sales

[57] ABSTRACT

An improved dual gridded reflector antenna configuration which allows cross-polarization radiation to be scanned in any given direction. The dual-gridded reflector assembly includes a front parabolic reflector illuminated by a first source, and a second parabolic reflector illuminated by a second source. The second reflector is positioned adjacent to and behind the front reflector such that the center points of the reflectors align to define a center axis. Additionally, the first and second sources are positioned at different offsets with respect to the reflectors and have a respective rotated offset angle with respect to the center axis such that the sources define an antenna feed separation. By modifying the offsets and the rotated offset angles, the feed separation can be designed to have an inclination with respect to the north-south or east-west feed separation direction.

9 Claims, 6 Drawing Sheets

DUAL GRIDDED REFLECTOR ANTENNA

TECHNICAL FIELD

The invention relates to dual-gridded reflector antennas and more particularly to dual-gridded offset reflector antennas for satellite communications.

BACKGROUND OF THE INVENTION

Dual-gridded reflector antennas consist of two separate polarized reflectors gridded in orthogonal directions, typically referred to as vertical and horizontal directions. Each reflector is illuminated by a single feed or a feed array, which is polarized along the direction of the respective grid. Typically, the two reflectors are nested, one behind the other, to provide beams with different shapes on, for example, vertical and horizontal polarization. For instance, the front reflector would reflect horizontally polarized signals from one feed while being nearly transparent to the orthogonal vertically polarized signals from the other feed. The rear reflector would reflect the vertically polarized signals from the other feed which pass through the front reflector. Cross-polarized radiation currents on a reflector from its respective feed are attenuated due to the grids. This component is referred to as the "right reflector" cross polarization. However, cross polarization currents from the feed induced on the orthogonally polarized reflector are not attenuated since the grids are aligned in the cross-polarized direction. This component, which is dependent on the relationship of the two reflectors, is called the "wrong reflector" cross polarization. Typically, the feeds are displaced from the focus of the orthogonally polarized reflector so the cross-polarized radiation is scanned away from the coverage area. Accordingly, the "wrong reflector" cross polarization depends on the feed separation and, therefore, is traded against mechanical complexity of the antenna construction. The "right-reflection" cross-polarization depends upon the grid parameters and so is easily controlled. The present invention relates to the scanning and suppression of the "wrong-reflection" cross-polarization.

Traditional dual-gridded reflector antennas fall into two categories. In the over-under configuration, the front and back reflectors have offset directions aligned as shown by the front view of the configuration shown in FIG. 2*a*. However, the respective offsets are different as shown by the side view of the configuration in FIG. 2*b*, resulting in a feed separation. In the rotated-offset configuration, the front and back reflectors have equal offsets and the offset directions are rotated with reference to each other, as shown by the front and side views in FIGS. 3*a* and 3*b* resulting in a feed separation. In both of these configurations, however, the direction of the feed separation (the line joining the two feeds) is either in the east-west direction or the north-south direction. Since the "wrong reflector" cross polarization radiation is scanned along the direction of the feed separation, in both of these configurations the scan would be in either the east-west or north-south direction. In satellite applications where coverage areas are very large in the north-south or east-west directions, traditional dual gridded reflector configurations required a large feed separation which results in a complex antenna configuration. In many applications, however, it is preferable to scan the cross polarized radiation in a direction other than pure north-south or east-west. Thus, there exists a need for a dual gridded reflector antenna configuration which allows the cross polarized radiation to be scanned in any given direction to improve cross polarized radiation performance and simplify the mechanical package.

SUMMARY OF THE INVENTION

The present invention is an improved dual gridded reflector antenna configuration which allows cross polarized radiation to be scanned in any given direction. The dual-gridded reflector antenna assembly includes a front parabolic reflector illuminated by a first source, and a second parabolic reflector illuminated by a second source. The second reflector is positioned adjacent to and behind the front reflector such that the center points of the reflectors align to define a center axis. Additionally, the first and second sources are positioned at different offsets with respect to the reflectors and have a respective rotated offset angle with respect to the center axis such that the sources define an antenna feed separation. By modifying the offsets and the rotated offset angles, the feed separation can be designed to have an inclination with respect to the north-south or east-west feed separation direction.

Other advantages of the invention will become apparent upon reading the following detailed description and appended claims, and upon reference to the accompanying drawings.

BRIEF DESCRIPTION OF THE DRAWINGS

For a more complete understanding of the invention, reference should now be had to the embodiments illustrated in greater detail in the accompanying drawings and described below by way of examples of the invention. In the drawings.

BEST MODE(S) FOR CARRYING OUT THE INVENTION

Figure 1:
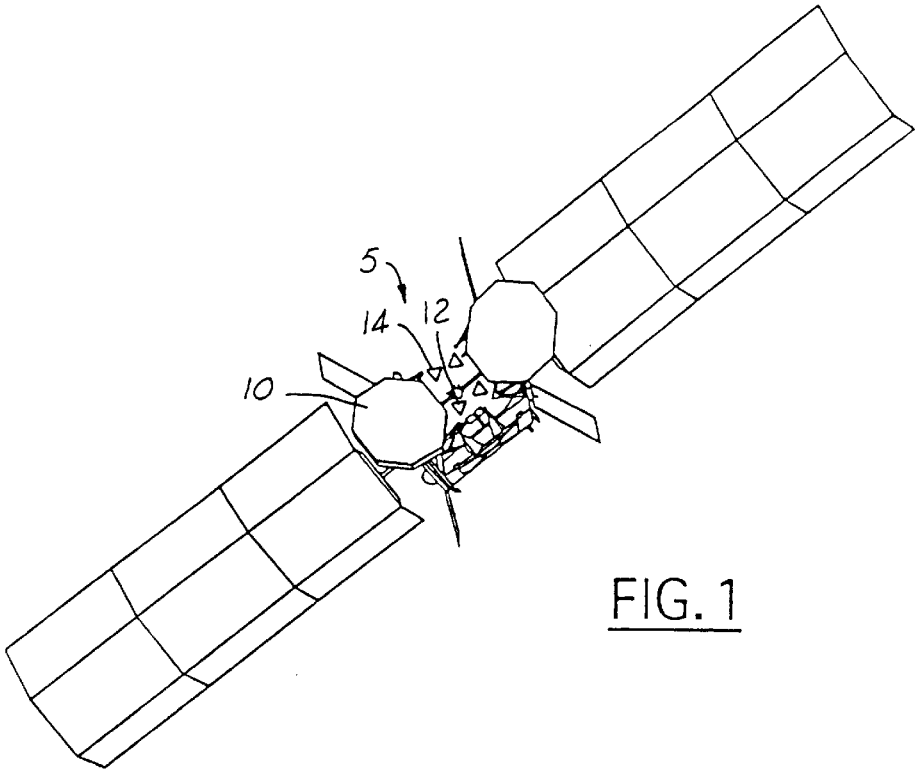
FIG. 1 is a dual reflector antenna within a satellite environment.

FIG. 1 shows a satellite 5 equipped with a rotated-offset dual-gridded reflector antenna 10. The reflectors are illuminated by respective feeds 12, 14. Dual-gridded reflector antennas are commonly used in satellite systems because the two antennas share the same physical aperature.

Figure 2A:
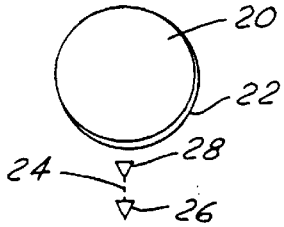
(PRIOR ART) FIG. 2a
FIG. 2A is a simplified schematic of a front view of a dual reflector antenna having an over-under configuration.
Figure 2B:
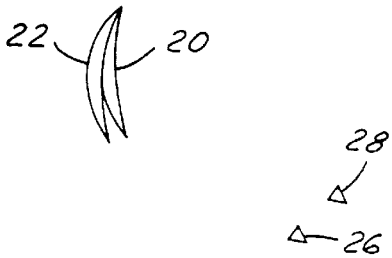
(PRIOR ART) FIG. 2b
FIG. 2B is a side view of the dual reflector antenna of FIG. 2A.

Turning to FIGS. 2A and 2B, there is shown a conventional dual-gridded reflector antenna having an over-under configuration. In this configuration, the front reflector 20 and the back reflector 22 have their offset directions aligned as shown in FIG. 2A, yet the offsets for the two feeds 26, 28 are different as shown in FIG. 2B. This results in a feed separation shown by the dotted line 24 in the north-south direction. Feed separation is directly related to the cross polarized radiation performance of the reflector antenna. For large antenna coverage areas, a large feed separation is typically required. However, the large feed separation increases the curvature of one of the offset reflectors, resulting in an increased thickness of the dual-gridded reflector antenna. This, in turn, results in a mechanically complex antenna system and, in some cases, the diameter of the reflector system must be reduced despite degraded co-polarized radiation performance.

Figure 3A:
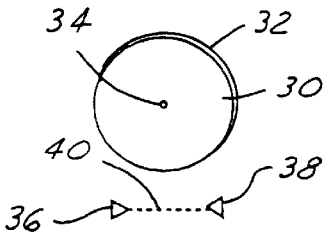
(PRIOR ART) FIG. 3a
FIG. 3A is a simplified schematic front view of a dual reflector antenna having a rotated offset configuration.
Figure 3B:
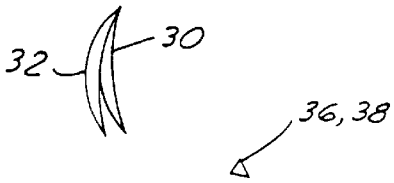
(PRIOR ART) FIG. 3b
FIG. 3B is a side view of the dual reflector antenna of FIG. 3A.

In FIGS. 3A and 3B, there is shown a simplified schematic view of a dual reflector antenna having a rotated offset configuration. In this configuration, the offsets of the front reflector 30 and the back reflector 32 are chosen to be equal, however, the focal axes of the two reflectors 30, 32 are rotated about the center of the reflector aperture 34. This results in a feed separation between the sources 36 and 38 in the east-west direction shown by dotted line 40.

For both the over-under configuration shown in FIG. 2 and the rotated offset configuration shown in FIG. 3, large feed separations are required for very large coverage areas since the direction of the cross polarized radiation scan is limited to an east-west or north-south scan. In many applications, however, it is preferred to scan the cross polarized radiation in the direction which is different from pure north-south or east-west.

Figure 4:
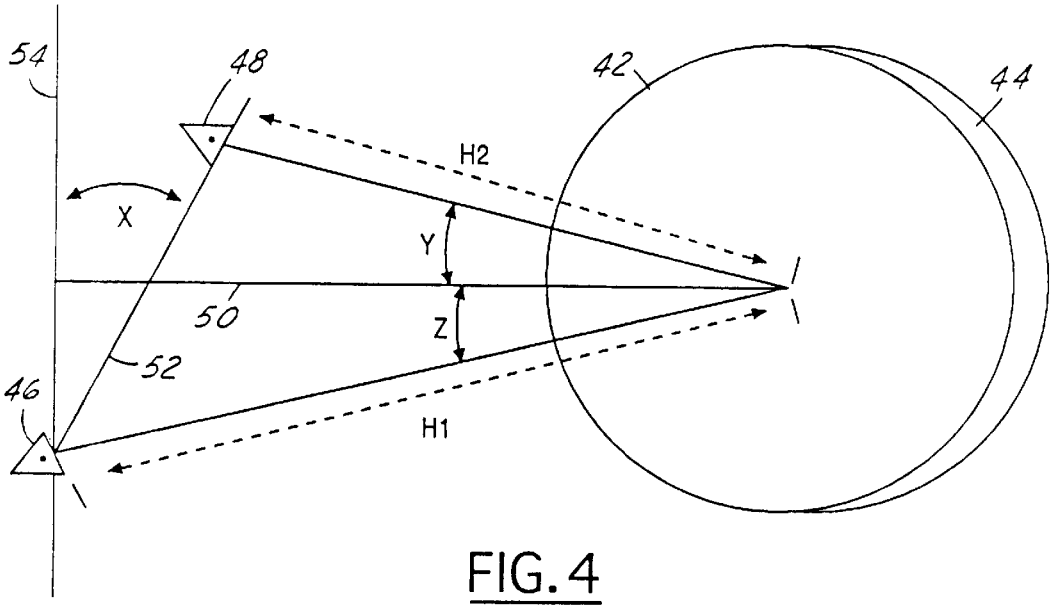
FIG. 4 is a simplified schematic view of an adaptable dual-gridded reflector antenna configuration in accordance with one embodiment of the present invention.
Figure 5A:
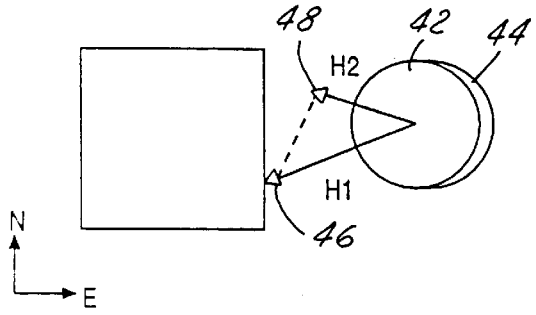
FIGS. 5*a–d* are simplified schematic views of four variations of the reflection antenna geometry and associated feed separation directions in accordance with the present invention.
Figure 5B:
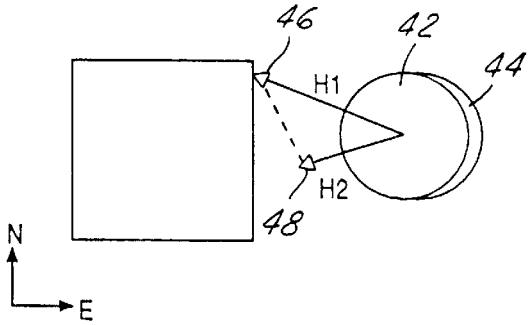
Figure 5C:
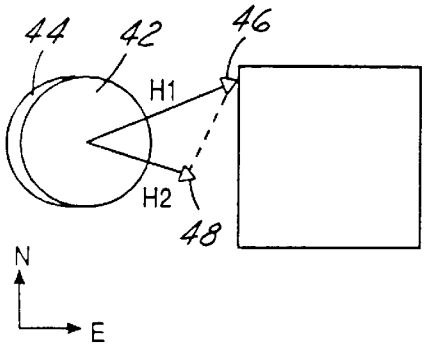
Figure 5D:
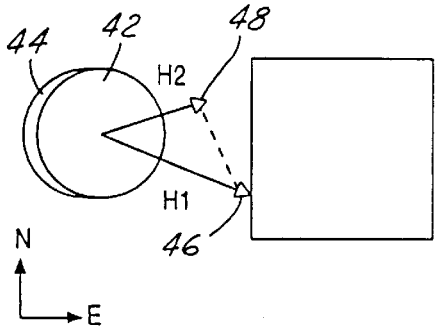

FIG. 4 shows a simplified schematic drawing of one embodiment of the dual-gridded reflector antenna configuration of the present invention. As shown in FIG. 4, the novel antenna geometry includes two dual-gridded reflectors 42 and 44 nested one behind the other. Each of the reflectors 42, 44 is illuminated by a respective feed 46, 48. The feeds 46 and 48 have different offsets H1 and H2, respectively. Additionally, the feeds 46 and 48 have an associated rotated offset angle Z and Y with respect to the center axis 50. The unequal offsets H1, H2 and the rotated offset angles Y, Z result in a feed separation 52 which is inclined at an angle X from the north-south axis 54. The inclination angle X can be obtained by the following equation:

$$\tan(x) = \frac{H1 * \cos(z) - H2 * \cos(y)}{H1 * \sin(z) + H2 * \sin(y)} \quad (1)$$

As shown in FIG. 4, offsets H1 and H2 represent the center heights of the respective reflectors 42 and 44. The center height is defined as the distance from the center of the focal axis to the center of the reflector.

FIGS. 5A through D show four variations of the reflector antenna geometry and the associated feed separation directions. FIGS. 5A through D demonstrate the flexibility provided by the present invention in designing the required cross polarized radiation scan direction. By adjusting the rotations and offsets of the feeds 46, 48 with respect to the reflectors 42, 44, many variations are possible.

Figure 6:
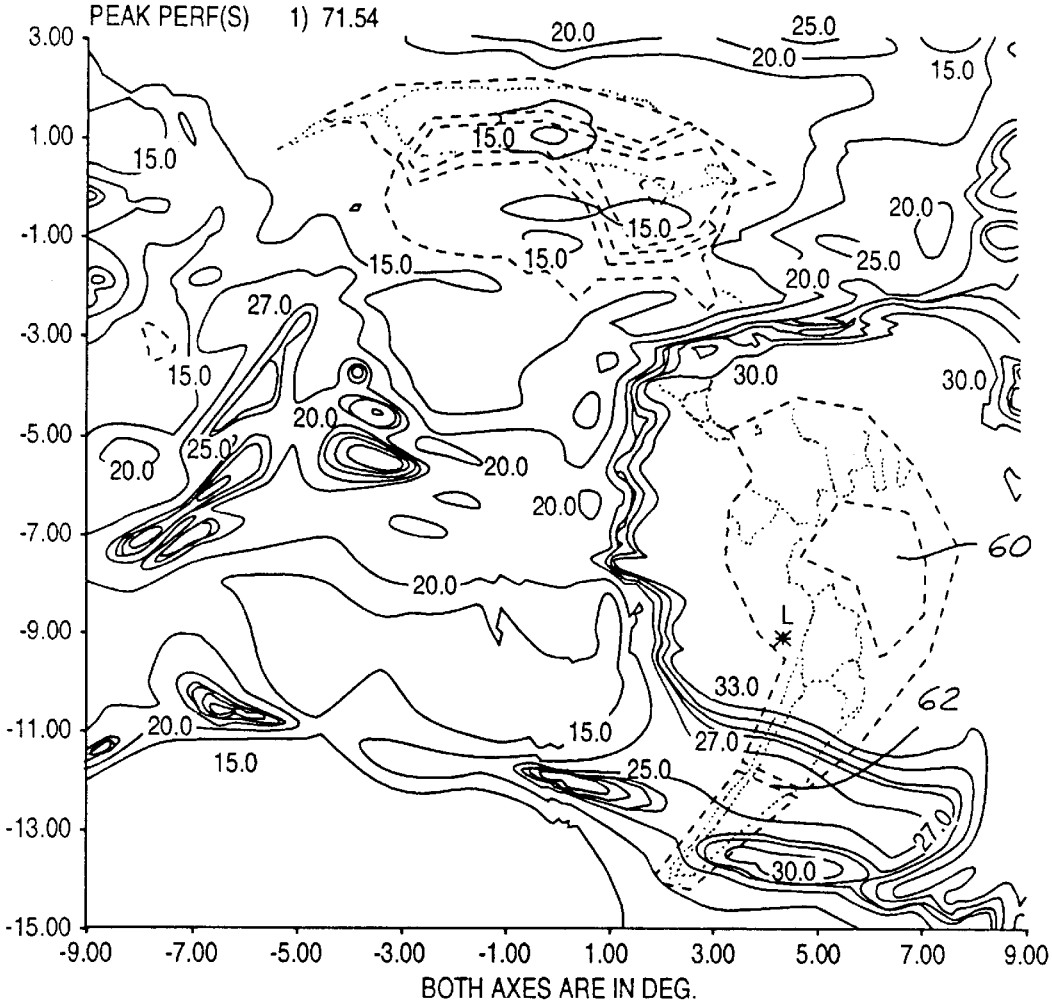
FIG. 6 is a schematic diagram of the cross-polarized performance pattern for South America with a conventional rotated offset reflector antenna.
Figure 7:
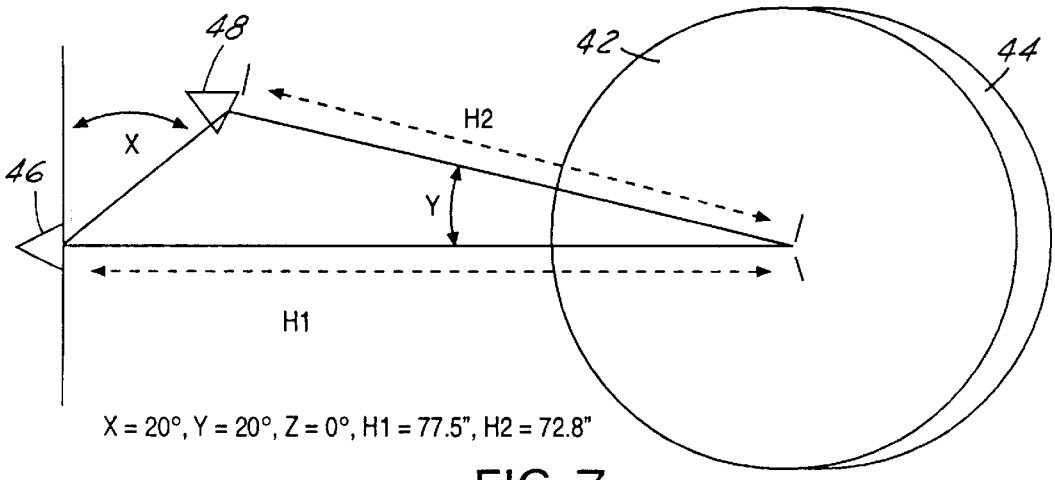
FIG. 7 is an antenna geometry in accordance with one embodiment of the present invention.
Figure 8:
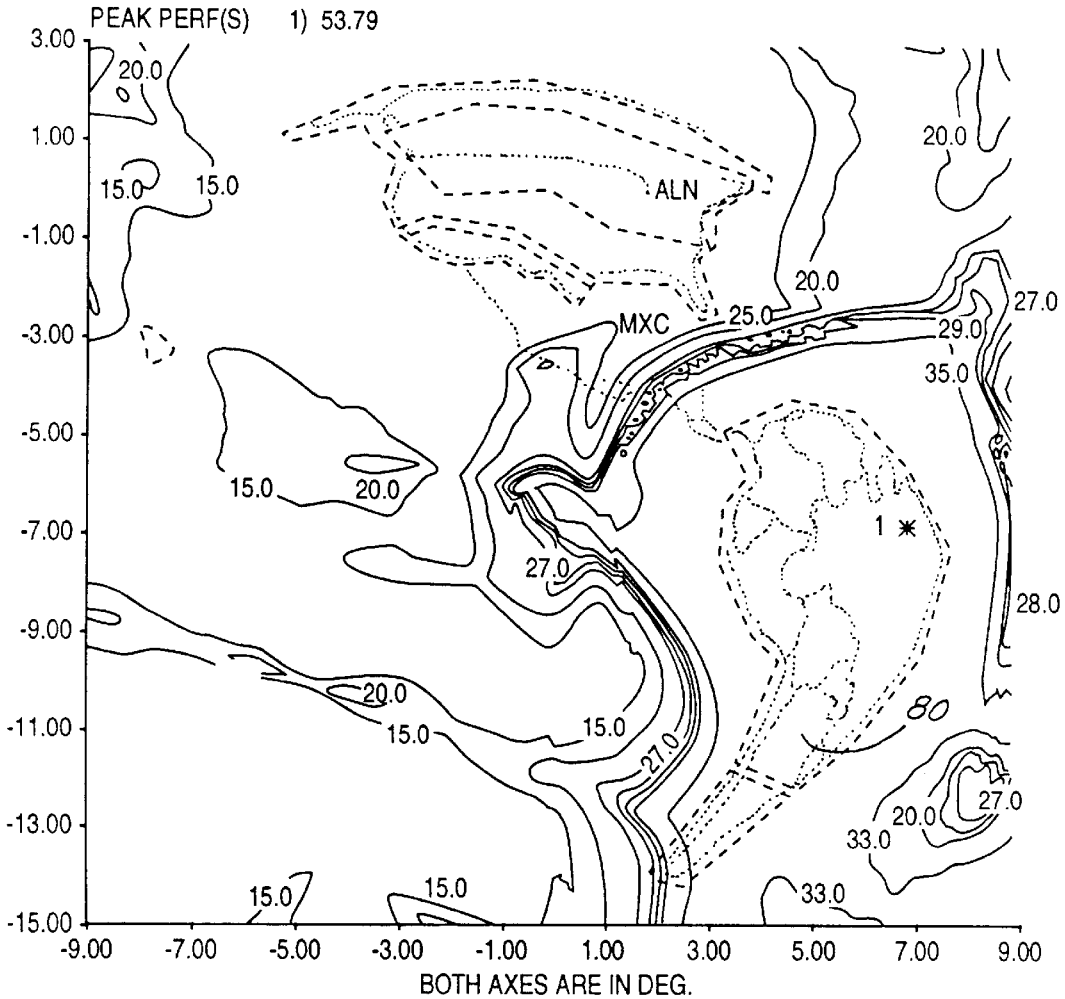
FIG. 8 is a schematic diagram of the cross-polarization performance of the antenna geometry of FIG. 7.

The advantages of the novel reflector antenna geometry will now be demonstrated by way of an example with reference to FIGS. 6, 7 and 8.

FIG. 6 shows the cross polarized radiation performance for South America by a conventional rotated offset reflector antenna. To achieve the cross polarized performance shown in FIG. 6, a conventional rotated offset antenna requires a very large feed separation along the north-south direction. As can be seen in FIG. 6, the cross polarized radiation performance for the conventional rotated offset antenna is satisfactory for the northern portion of South America 60, however, performance falls off dramatically (below 27 dB) in the southern portion of the continent 62. An examination of the coverage pattern of FIG. 6 reveals that improved cross polarized radiation performance can be obtained by scanning the cross polarized radiation in a direction inclined at 20 degrees with respect to the north-south direction.

FIG. 7 shows the antenna geometry necessary to achieve a cross polarized scanning direction inclined at 20 degrees with respect to the north-south direction. Equation (1) is used as a design tool for choosing reflector geometries such as offset heights (H1 and H2) and rotated offset angles (X, Y). The antenna geometry that gives an inclination angle of 20° and also meets desired mechanical packaging constraints, results in offset H1=77.5 inches, offset H2=72.8 inches, rotated offset angle Y=20° and rotated offset angle Z=0°.

FIG. 8 depicts the improved cross polarized radiation performance achieved with the antenna geometry of FIG. 7. As shown in FIG. 8, cross polarized radiation performance is significantly improved in the southern portion of South America 80 (about 9 dB) over the conventional rotated offset antenna cross polarized radiation pattern shown in FIG. 6.

Figure 9:
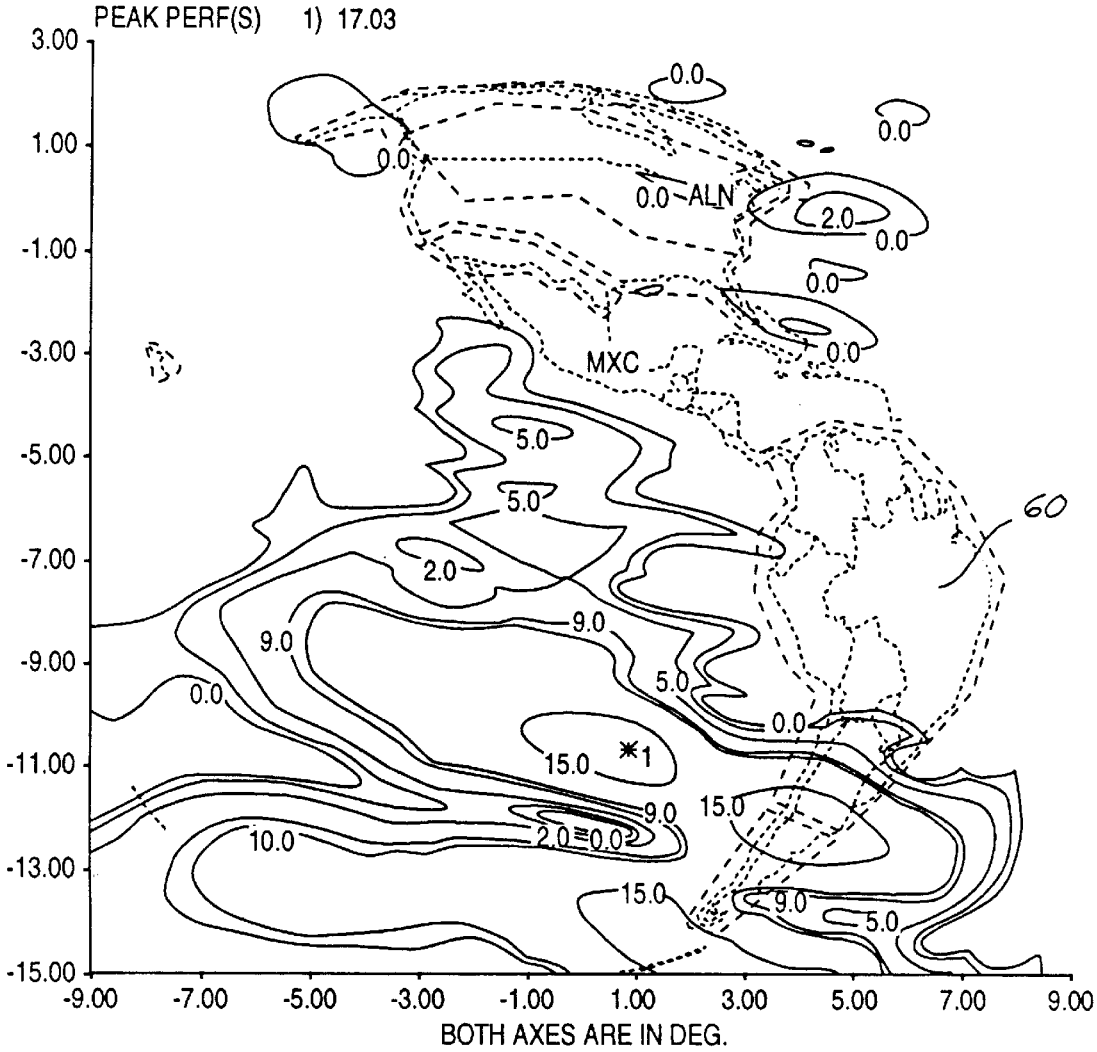
FIG. 9 is a schematic diagram of the cross-polarization interference pattern for South America with a conventional rotated-offset antenna.
Figure 10:
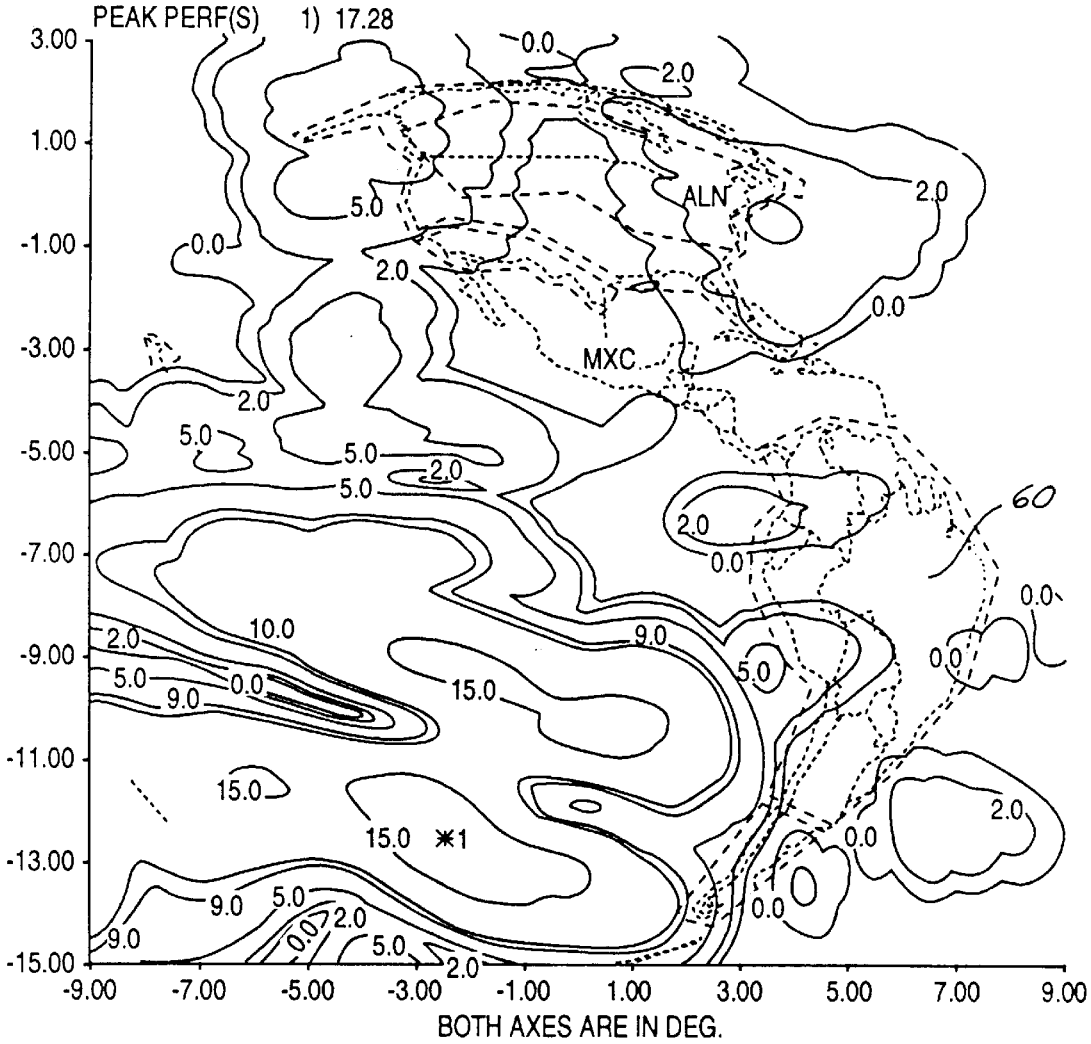
FIG. 10 is a schematic diagram of the cross-polarization interference pattern for the antenna geometry of FIG. 7.

FIGS. 9 and 10 show the cross-polarization interference patterns for South America 60 for the conventional rotated-offset antenna and the improved cross-polarization interference of the embodiment of FIG. 7 having an optimal inclination angle. As illustrated in FIG. 10, the interference pattern for the improved geometry is pointing away from the north-west direction by an angle approximately equal to the optimized inclination angle. As can be seen, the cross-polarization interference is reduced on South America 60 by about 9 dB.

In this example, the desired inclination angle can be achieved by equal offsets and unequal rotation angles, or unequal offsets and rotation angles. For instance, an inclination angle of 20° in the north-west direction could be achieved by asymmetrical offset rotation angles with equal offsets H1 and H2. Solving equation (1), the two rotations would be 90° and 130° for the front and back reflectors, respectively; with H1 and H2=77.5 inches. However, by choosing different offsets of, for example, H1=77.5 inches and H2=72.8 inches, the rotation angles can be minimized for the front and back reflectors to achieve the desired inclination angle of 20° north-west. Solving equation (1), the front rotator offset angle would be 90° and the back reflector rotation offset angle would be 110°. Accordingly, the feed separation can be minimized thereby improving the mechanical design of the overall antenna system.

While the invention has been described in connection with one or more embodiments, it will be understood that the invention is not limited to those embodiments. On the contrary, the invention covers all alternatives, modifications, and equivalents as may be included within the spirit and scope of the appended claims.

What is claimed is:

1. A dual gridded reflector antenna assembly comprising:

a front parabolic reflector;

a back parabolic reflector positioned adjacent to and behind said front parabolic reflector such that the center point of said front and back parabolic reflectors define a center axis;

a first source illuminating said front parabolic reflector, said first source positioned in front of said front and back parabolic reflectors at a first offset and rotated at a first angle with respect to the center axis; and a second source illuminating said back parabolic reflector, said second source positioned in front of said front and back parabolic reflectors at a second offset and rotated at a second angle with respect to the center axis such that said first and second sources define an antenna feed separation having an inclination angle with respect to north-south direction said inclination angle defined by the following equation:

$$\tan(x) = \frac{H1 * \cos(z) - H2 * \cos(y)}{H1 * \sin(z) + H2 * \sin(y)}$$

wherein x is inclination angle, H1 and H2 are the first and second offsets, respectively, and z and y are the first and second rotated offset angles, respectively.

2. The dual gridded reflector antenna assembly of claim 1 wherein said first and second offsets are different and said first and second rotated angles are equal.

3. The dual gridded reflector antenna assembly of claim 1 wherein said first and second offsets are different and said first and second rotated angles are different.

4. The dual gridded reflector antenna assembly of claim 1 wherein said front and back parabolic reflectors reflect vertically polarized and horizontally polarized signals, respectively.

5. The dual gridded reflector antenna assembly of claim 1 wherein said first and second sources are single feed sources.

6. The dual gridded reflector antenna assembly of claim 1 wherein said first and second sources are feed arrays.

7. A method of optimizing the cross-polarized radiation performance of a dual-gridded reflector antenna having a front parabolic reflector illuminated by a first source and a back parabolic reflector illuminated by a second source said front and back parabolic reflectors positioned adjacent to each other such that the center point of said front and back parabolic reflectors define a center axis, the method comprising the steps of:

positioning said first source at a first offset with respect to the focal point of said first reflector and at a first rotated offset angle with respect to the center axis; and positioning said second source at a second offset with respect to the focal point of said second reflector and at a second rotated offset angle with respect to the center axis such that said first and second sources define an antenna feed separation having an inclination angle with respect to north-south direction said inclination angle defined by the following equation:

$$\tan(x) = \frac{H1 * \cos(z) - H2 * \cos(y)}{H1 * \sin(z) + H2 * \sin(y)}$$

wherein x is inclination angle, H1 and H2 are the first and second offsets, respectively, and z and y are the first and second rotated offset angles, respectively.

8. The method of claim 7 wherein said step of positioning said second source further includes the step of positioning said second source at an offset different from said first offset and at a second rotated offset angle equal to the first rotated offset angle.

9. The method of claim 7 wherein said step of positioning said second source further includes the step of positioning said second source at an offset different from said first offset and at a second rotated offset angle different from the first rotated offset angle.

* * * * *